US005992319A

United States Patent [19]

Hsu

[11] Patent Number: 5,992,319

[45] Date of Patent: Nov. 30, 1999

[54] SEAL

[75] Inventor: Ming-Tai Hsu, Taipei, Taiwan

[73] Assignee: Hsiang Yuan L.T.D., Chung-Li, Taiwan

[21] Appl. No.: 09/172,629

[22] Filed: Oct. 14, 1998

[51] Int. Cl.[6] ..... B41L 47/02

[52] U.S. Cl. ..... 101/368; 101/405

[58] Field of Search ..... 101/368, 405, 101/372, 379

[56] References Cited

U.S. PATENT DOCUMENTS

| | | | |
|---|---|---|---|
| 5,178,067 | 1/1993 | Collier | 101/368 |
| 5,579,692 | 12/1996 | Collier | 101/368 |
| 5,647,278 | 7/1997 | Wu | 101/368 |
| 5,738,011 | 4/1998 | Tay | 101/368 |

FOREIGN PATENT DOCUMENTS

| | | | |
|---|---|---|---|
| 0162270 | 7/1988 | Japan | 101/368 |

*Primary Examiner*—Edgar Burr
*Assistant Examiner*—Anthony H. Nguyen
*Attorney, Agent, or Firm*—A & J

[57] ABSTRACT

A seal includes a transparent decoration, a hollow body having a bottom formed with an upwardly extending neck, a seat having a raised top fitted in a bottom of the transparent decoration and a lower portion fitted in the cylindrical body, a circuit board fitted in a lower portion of the seat and having a top on which are mounted an music integrated circuit, a light emitting means and a buzzer and a bottom on which are mounted at least a battery mounting and a switch, the light emitting means, the buzzer and the switch being electrically connected to the integrated circuit, a spring arranged within the body and having a lower end bearing against the neck and an upper end bearing against the circuit board, a rubber pad fixedly fitted in a bottom of the body, and a bottom cover engageable with the bottom of the body to cover the rubber pad, whereby the seal will give light and send out music when in use.

9 Claims, 4 Drawing Sheets

SEAL

BACKGROUND OF THE INVENTION

1. Field of the Invention

This invention is related to a seal and in particular to one which will give light and produce music when in use.

2. Description of the Prior Art

A seal is a device used to identify or replace the signature of an individual or organization and to authenticate written matter purportedly emanating from such individual or organization. The use of seals is very ancient, examples of great antiquity occurring in China, Egypt, Greece, Rome and other places. However, the seal never changes in structure thereby making it dull and monotonous.

Therefore, it is an object of the present invention to provide a seal which will give light and produce music when in use.

SUMMARY OF THE INVENTION

This invention is related to an interesting seal.

According to a preferred embodiment of the present invention, a seal includes a transparent decoration, a hollow body having a bottom formed with an upwardly extending neck, a seat having a raised top fitted in a bottom of the transparent decoration and a lower portion fitted in the cylindrical body, a circuit board fitted in a lower portion of the seat and having a top on which are mounted an music integrated circuit, a light emitting means and a buzzer and a bottom on which are mounted at least a battery mounting and a switch, the light emitting means, the buzzer and the switch being electrically connected to the integrated circuit, a spring arranged within the body and having a lower end bearing against the neck and an upper end bearing against the circuit board, a rubber pad fixedly fitted in a bottom of the body, and a bottom cover engageable with the bottom of the body to cover the rubber pad.

It is the primary object of the present invention to provide a seal which will give light and send out music when in use.

It is another object of the present invention to provide a seal which is easy to assembly.

It is still another object of the present invention to provide a seal which is simple in construction.

It is another object of the present invention to provide a seal which can be used as a decoration.

It is a further object of the present invention to provide a seal which is facile to use.

DETAILED DESCRIPTION OF THE PREFERRED EMBODIMENT

Figure 1:
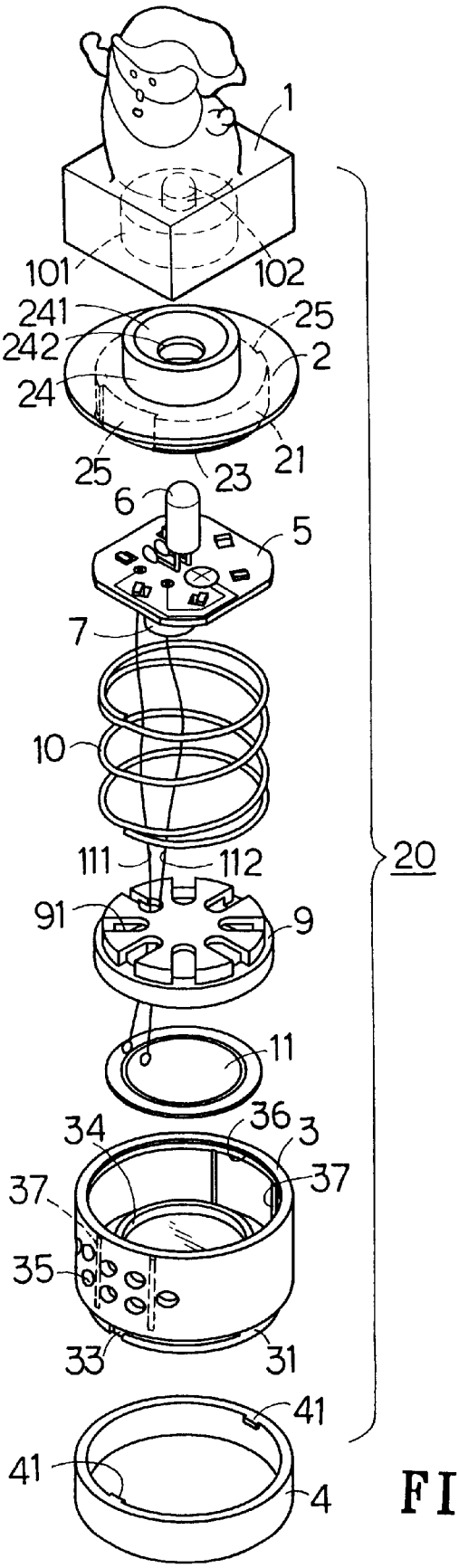
FIG. 1 is an exploded view of a seal according to the present invention.
Figure 2:
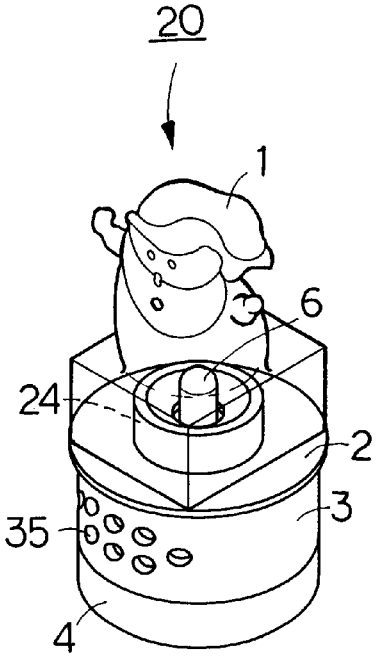
FIG. 2 is a perspective view of the seal.
Figure 3:
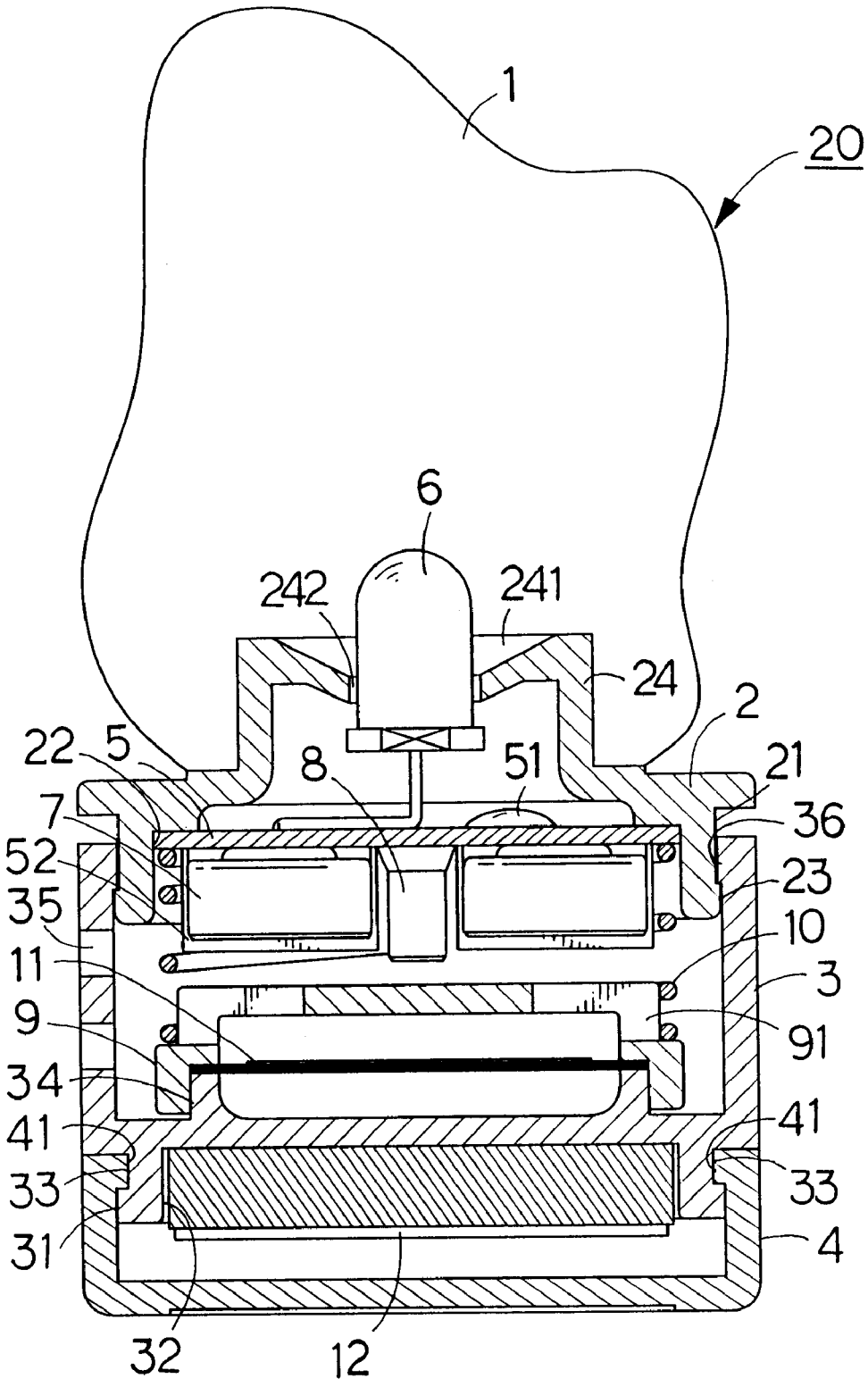
FIG. 3 is a sectional view of the seal

With reference to the drawings and in particular to FIGS. 1, 2 and 3 thereof, the seal 20 according to the present invention generally comprises a transparent decoration 1, a seat 2 under the transparent decoration 1, a body 3 under the seat 2, a bottom cover 4 under the body 3, a circuit board 5 mounted on the bottom of the seat 2, a light emitting means 6 arranged on the upper side of the circuit board 5, a plurality of batteries 7 fitted on the bottom side of the circuit board 5, a switch 8 mounted on the bottom side of the circuit board 5, an acoustic hood 9, a spring 10 arranged between the acoustic hood 9 and the circuit board 5, a buzzer 11 mounted under the acoustic hood 9, and a rubber pad 12 with an emblem at the bottom mounted on the bottom of the body 3.

As shown in FIGS. 1 and 3, the body 3 is a hollow cylindrical member the bottom of which is formed with a raised circular neck 34 extending upwardly therefrom. A circular flange 31 extends radially outwardly from the lower edge of the body 3. The lower side of the bottom of the body 3 is formed with a cavity 32 in which is fitted the rubber pad 12. The flange 31 is formed with two opposite inverted L-shaped grooves 33 adapted to receive two opposite protuberances 41 at the upper inner rim of the bottom cover 4 so that the bottom cover 4 can be turned and locked on the body 3 to protect the rubber pad 12. The acoustic hood 9 is fitted on the circular neck 34 of the body 3 thereby forming a chamber for receiving the buzzer 11. The body 3 is formed with a plurality of perforations 35 for transmission of the music produced by the buzzer 11. The inner side of the body 3 has two pairs of longitudinal ribs 37 adapted to engage with two radial recesses 25 for guiding the movement of the body 3 so that the seat 2 can only be moved up and down along the body 3.

The acoustic hood 9 is preferably made of flexible material and formed with a plurality of holes 91 at the top. The acoustic hood 9 is fitted on the circular neck 34 of the body 3 to form a chamber in which is arranged the buzzer 11. The buzzer 11 is electrically connected to the circuit board 5 by two electrical wires 111 and 112.

The spring 10 is mounted on the top of the acoustic hood 9. The circuit board 5 is provided with a light emitting means 6 (a light emitting diode or a small light bulb) and a music integrated circuit IC 51 at the top and a switch 8, and a plurality of battery mountings 52 at the bottom. The light emitting means 6, the switch 8 and the buzzer 11 are electrically connected to the IC 51. Batteries 7 are installed in the battery mountings 52 for supplying power to the circuit board 5.

The seat 2 is mounted on the body 3 and has a lower portion 21 which is cylindrical in shape and formed with a cavity 20 adapted to receive the circuit board 5. The lower edge of the lower portion 21 of the seat 2 is formed with an outwardly extending flange 23 adapted to engage with an inwardly extending flange 36 at the upper edge of the body 3 thereby preventing the seat 2 from disengaging from the body 3. The seat 2 has a raised top 24 formed with a conical recess 241 having a central opening 242 for receiving the light emitting means 6. The conical recess 241 is used for converging and reflecting light from the light emitting means 6.

The transparent decoration 1 may be made of translucent material and has a cavity 101 at the bottom for receiving the raised top 24 of the seat 2. The cavity 101 is formed at the center with a recess 102 for receiving the light emitting means 6 so that when the light emitting means 6 is powered, it will make the transparent decoration 1 to give light thereby making it very attractive and interesting.

The circuit board 5 and the seat 3 are mounted on the spring 10 so that the spring 10 tends to push the circuit board 5 and the seat 3 to go upwardly thereby providing a distance between the switch 8 and the acoustic hood 9. Meanwhile, the IC 51, the light emitting means 6 and the buzzer 1 are not powered.

Figure 4:
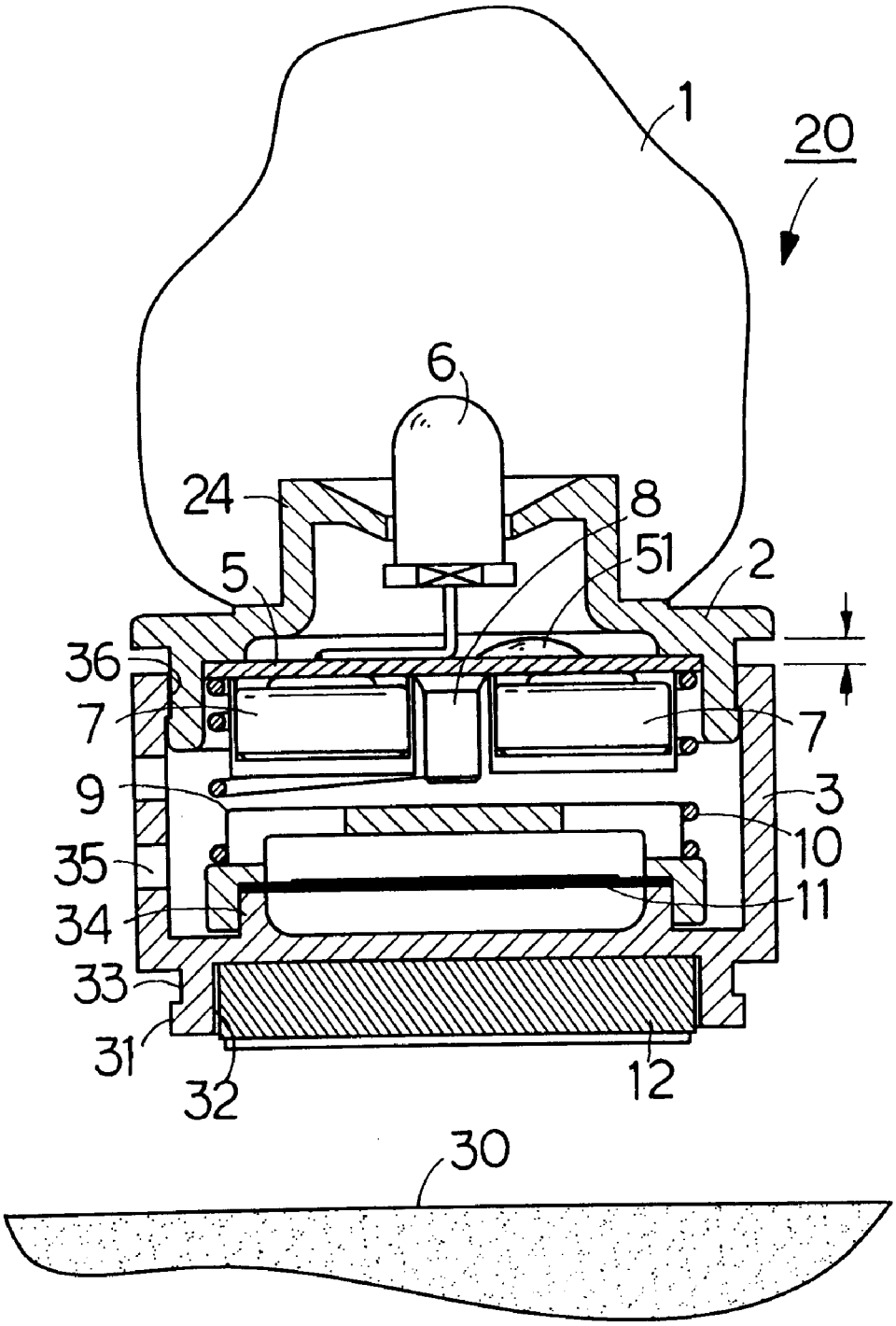
FIG. 4 is a sectional view of the seal with the bottom cover removed.
Figure 5:
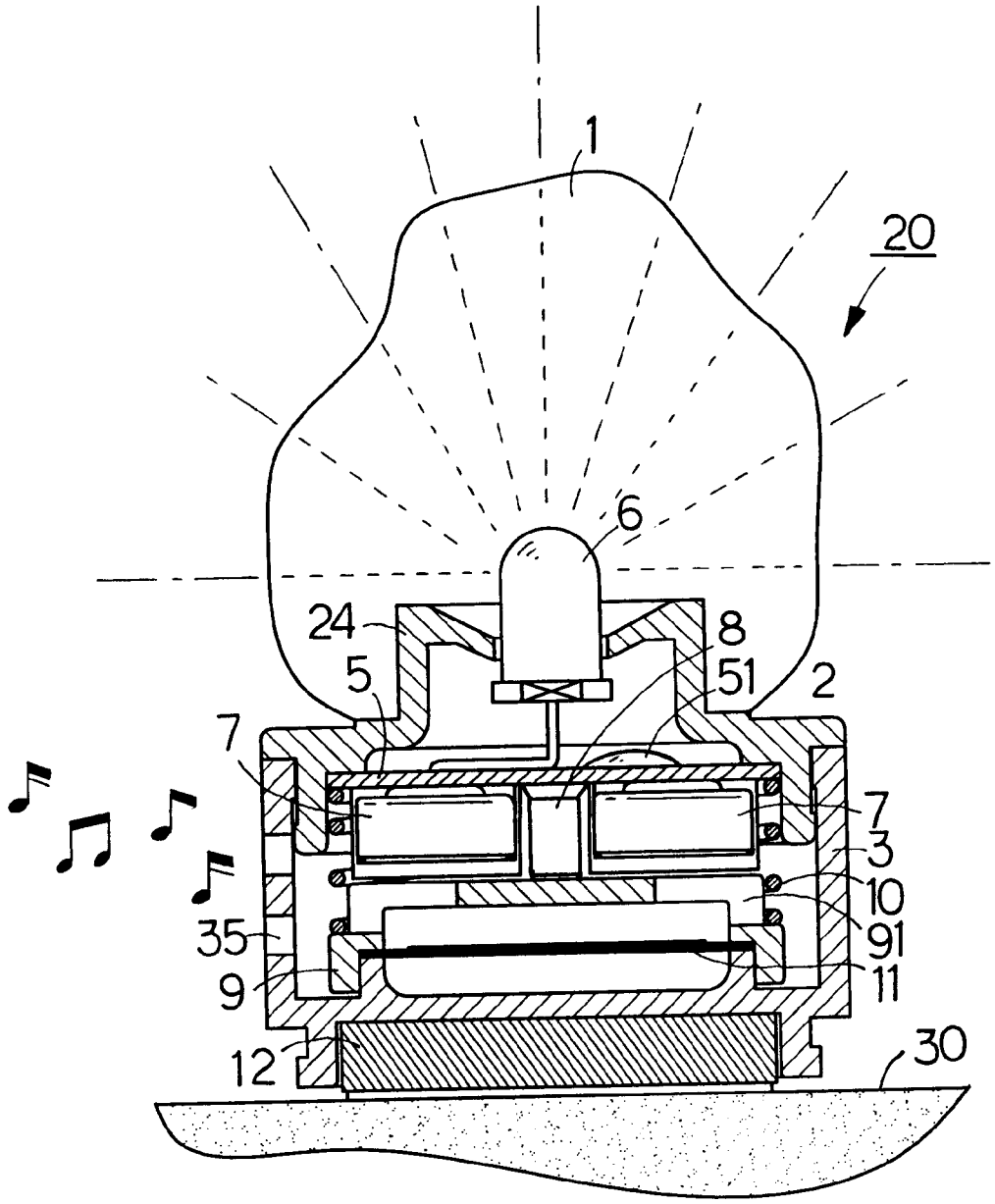
FIG. 5 illustrates the working principle of the seal.

Referring to FIG. 4, when in use, the bottom cover 4 is first removed from the body 3. Then, the seal 20 is moved downwardly on a piece of paper 30 and the transparent decoration 1 is further pressed so that the transparent decoration 1, the seat 3 and the circuit board 5 are moved downwardly altogether with respect to the body 3. In the meantime, the switch 8 is forced on the top of the acoustic hood 9 thereby turning on the switch 8 and therefore triggering the IC 51 which will in turn make the light emitting means 6 to give light and the buzzer 11 to produce music. In addition, the light sent out by the light emitting means 6 will go through the transparent decoration 1 to make it fascinating and the music produced by the buzzer 11 will go through the perforations 35 of the body 3. The light and the music will last for 20 seconds once the switch 8 is turned on. When the user does not apply pressure on the transparent decoration 1, the spring 10 will move the circuit board 5, the seat 3 and the transparent decoration 1 to go upwardly back to their original positions thus turning off the switch 8.

It should be noted that the acoustic hood 9 and the buzzer 11 can be easily removed if it is only desired to have the seal 20 to give light in use. Similarly, if it is desired to have music only, simply remove the light emitting means 6 from the circuit board 5.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A seal comprising:

a transparent decoration;

a hollow body having a bottom formed with an upwardly extending neck;

a seat having a raised top fitted in a bottom of said transparent decoration and a lower portion fitted in said cylindrical body;

a circuit board fitted in a lower portion of said seat and having a top on which are mounted an music integrated circuit, a light emitting means and a buzzer and a bottom on which are mounted at least a battery mounting and a switch, said light emitting means, said buzzer and said switch being electrically connected to said integrated circuit;

a spring arranged within said body and having a lower end bearing against said neck and an upper end bearing against said circuit board;

a rubber pad fixedly fitted in a bottom of said body; and a bottom cover engageable with said bottom of said body to cover said rubber pad.

2. The seal as claimed in claim 1, further comprising an acoustic hood fitted on said circular neck of said body and a buzzer mounted under said acoustic hood.

3. The seal as claimed in claim 1, wherein said body is formed with a plurality of perforations.

4. The seal as claimed in claim 1, wherein said seat has a lower edge formed with an outwardly extending flange and said body portion has an upper edge formed with an inwardly extending flange engageable with said outwardly extending flange.

5. The seal as claimed in claim 1, wherein said seat is formed with a conical recess having an central opening.

6. The seal as claimed in claim 2, wherein said circular neck extends upwardly from a bottom of said body to form a chamber for receiving said buzzer.

7. The seal as claimed in claim 2, wherein said acoustic hood is formed with a plurality of holes.

8. The seal as claimed in claim 1, wherein said body has a circular flange extending radially outwardly from a lower edge thereof and formed with two opposite inverted L-shaped grooves, and said bottom cover has an upper inner rim formed with two protuberances engageable with said grooves.

9. The seal as claimed in claim 1, wherein an inner side of said body is provided with two pairs of longitudinal ribs and said seat has a lower portion formed with two recesses configured to be slidably engaged with said ribs.

* * * * *